United States Patent [19]

Bambuch et al.

[11] 4,249,964

[45] Feb. 10, 1981

[54] PROCESS FOR THE CHEMICAL AND THERMAL TREATMENT OF STEEL PARTS TO IMPROVE THE STRENGTH PROPERTIES THEREOF

[75] Inventors: Tadeusz Bambuch; Henryk Wilusz; Wieslaw Englert; Stanislaw Czank; Stanislaw Surmiak, all of Stalowa Wola, Poland

[73] Assignee: Huta Stalowa Wola-Kombinat Przemyslowy, Stalowa Wola, Poland

[21] Appl. No.: 136,137

[22] Filed: Mar. 31, 1980

Related U.S. Application Data

[63] Continuation-in-part of Ser. No. 28,484, Apr. 9, 1979, abandoned.

[51] Int. Cl.[3] ..... C21D 1/48

[52] U.S. Cl. ..... 148/16.5; 148/6.15 Z; 148/31.5

[58] Field of Search ..... 148/15.5, 16.5, 31.5, 148/6.15 R, 6.15 Z

[56] References Cited

U.S. PATENT DOCUMENTS

| | | | |
|---|---|---|---|
| 3,397,092 | 8/1968 | Cavanagh | 148/6.15 Z |
| 3,615,891 | 6/1979 | Davis | 148/16.5 |
| 4,194,929 | 3/1980 | Menke | 148/31.5 |

FOREIGN PATENT DOCUMENTS 1297016 11/1972 United Kingdom .

*Primary Examiner*—L. Dewayne Rutledge
*Assistant Examiner*—John P. Sheehan
*Attorney, Agent, or Firm*—Ladas & Parry

[57] ABSTRACT

The present invention relates to a process for the chemical and thermal treating of steel parts such as gear wheels, shafts and sleeves, for increasing their fatigue strength, hardness and wear resistance, the process being characterized by following the successive applied steps of phosphatizing, carburizing, hardening and tempering.

5 Claims, No Drawings

PROCESS FOR THE CHEMICAL AND THERMAL TREATMENT OF STEEL PARTS TO IMPROVE THE STRENGTH PROPERTIES THEREOF

This is a continuation-in-part of Patent Application Ser. No. 28,484, filed Apr. 9, 1979 now abandoned.

This invention relates to a process for the thermal and chemical treatment of steel parts, such as gear wheels, shafts and sleeves, to provide high strength properties of the said parts, including improved hardness and fatigue strength as well as substantially uniform surfaces.

In industry there has already been used for a long time, carburizing of steel parts, that is, a diffusion increase of carbon content in the superficial layer of the steel, most often up to 1 mm. in depth with subsequent hardening and tempering. Owing to an increased content of carbon and various alloy additions, such as, for example, manganese, chromium, molybdenum and nickel, upon hardening of such parts there is obtained in the superficial layer a martensite structure of approximately 60 HRC Rockwell hardness number.

Because in industry a lower hardness, even as low as 40 to 50 HRC, 430 to 500 HV hardness value, was often observed, or local areas of lower hardness were noticed leading to a shortened life of the part, research work has been undertaken in many countries aimed at elucidating the reasons for this drawback and correcting it.

Microscopic investigations together with determination of the chemical compositions have led to the conclusion that soft spots on the carburized, hardened and tempered parts do not have martensitic structure, but rather have some intermediate structures, such as bainite, and sometimes even pearlite. This is due to an oxidation of alloying components in the steel during a prolonged carburization of parts at an elevated temperature and in a carburizing atmosphere, particularly one which may contain some combined oxygen, and it is well known that the latter atmospheres are far most often used for economical reasons. Oxides produced during carburization accumulate mainly on the surface of the part and form a thin, very brittle superficial layer which does not produce martensite when the part is hardened. In deeper layers the oxides accumulate mainly along the boundaries of the grains and accelerate corrosion of the carburized parts. Moreover, the oxides deprive the steel of alloying components sometimes only in some places, thus reducing their hardenability.

Since the avoidance of oxidation requires expensive techniques, such as carburizing by means of methane in vacuum or in an atmosphere of nitrogen or hydrogen, or an atmosphere of similar neutral gases, various methods have been proposed for the removal of the damaged superficial oxide layer and to ensure an improvement of the strength properties of the carburized, hardened and tempered parts by means of cold working.

Still other proposals for the removal of the oxide layer are grinding, sand blasting, or pickling.

United Kingdom Patent Specification No. 1,297,016 discloses a process for increasing the strength of case hardened parts by the electrolytic or mechanical removal of defective peripheral oxide layer. U.S. Pat. No. 3,615,891 discloses a method of treating ferrous metal parts comprising the steps of (1) case hardening the exterior surface of the part by carburizing; (2) phosphatizing the surface of the carburized part; and (3) cold working the exterior surface of the part by shotpeening or other appropriate method. U.S. Pat. No. 3,397,092 discloses a process for imparting improved corrosion resistance to case hardened ferrous metal surfaces comprising heating the surface, removing any oleaginous material and applying a protective phosphate coating to the heat-treated metal surface.

It is known from the relevant technical literature that the effect of oxidation of steel during carburization is not limited to a zone of strong oxidation visible by microscope. Losses of content of alloying components and generation of oxides on the grain boundaries extend ten times deeper than the above mentioned superficial oxide layer. The content of alloying components is considerably reduced within the whole of the above mentioned zone, the said alloying components being diffused toward the surface during carburization and being there oxidized, the characteristic feature of this phenomenon being that the losses of alloying components and oxides are not uniformly distributed throughout the whole surface. In such cases, on the surfaces of the ready-made parts, there are hard and soft areas which disqualify these parts for use. What is worse, the defects in these parts are often unnoticed by technical control and are revealed only when the parts are in operation, thus leading to serious losses.

The present invention provides an improved and simplified process of thermal and chemical treatment of steel parts which ensures better strength properties, particularly hardness and fatigue strength, high resistance to corrosion and uniform distribution of said properties throughout the whole surface area of the part.

In accordance with the present invention there is provided a process for improving the strength, hardness and surface properties of a steel part by a chemical and thermal treatment of the parts which comprises the steps of phosphatizing, carburizing, hardening and tempering the parts carried out in the following sequential order: (1) phosphatizing the part by treatment with an acidic phosphatizing solution containing zinc ions and phosphate ions to produce on the part a coating ranging in the thickness from 5 to 20 microns, the main ingredient of the coating being zinc phosphate; (2) carburizing the resulting phosphatized part in a gaseous carbon-containing atmosphere; and (3) hardening the part until the superficial layer is substantially all martensite and finally tempering the part.

It is a feature of the present invention that the gaseous atmosphere used for the carburizing step may contain some oxygen in combined form, for example, as carbon monoxide or carbon dioxide, without subsequent detriment to the surface of the part.

Phosphatizing aimed at coating the part with the above mentioned layer of zinc phosphate is effected by dipping the part in a chemical solution which will provide a layer of zinc phosphate on the metal surface. Small additions of iron phosphate or manganese phosphate to the zinc phosphate are of no significance and also may be allowed.

In the Examples, the chemical composition of each of two aqueous solutions suitable for the production of zinc phosphate coatings is given.

It has been shown that the superficial layer of the steel parts treated according to the present invention are substantially free from traces of oxidation, or defective oxides. Furthermore, the parts do not have soft spots with an intermediate or pearlite structure in spite of the fact that the said parts have not been subjected either to any additional operation for the removal of the superficial layer, or to cold strengthening.

These observations have also been confirmed by metallographic investigations and hardness tests carried out on parts treated according to this invention and comparison parts which have been only carburized, hardened and tempered. The results of these tests are given in the table set out hereinafter. In the parts which have been phosphatized, carburized, hardened and tempered, a uniform hardness equal to 62–63 HRC has been obtained over the whole surface, whereas the hardness of parts which have been carburized, hardened and tempered only, is not uniform and amounts to 40–50 HRC in soft places only.

On the other hand, no detrimental effect of the preceding phosphatizing step on the carburizing process is exhibited under conditions so far used, depending upon the given steel grade and the required carburizing depth. In consequence there is no need to change any carburizing parameters.

Still another advantage of the process according to the invention is simplification of treatment. Phosphatizing is a rather inexpensive operation of short duration, and when performed prior to carburization it ensures high strength properties and eliminates the necessity for galvanic removal of the oxidized superficial layer or cold working of the parts being previously carburized and hardened, e.g., by means of shotpeening, cold drawing or rolling.

The following Examples illustrate the invention and the manner in which it may be performed.

EXAMPLE 1

Finished gear wheels with modulus 6 made of low alloy structural steel containing 0.2 percent of carbon, 0.8 percent of manganese, 0.3 percent of silicon, 0.6 percent of chromium, 0.5 percent of nickel, 0.2 percent of molybdenum, 0.03 percent of aluminum by weight and the usual amounts of incidental ingredients such as phosphorus, sulphur and copper, were phosphatized, after previous cleaning and degreasing, by being dipped for ten minutes, at a temperature of 97° C., in an aqueous solution having the following chemical composition: 35 g./l. of a salt mixture consisting of 35 percent by weight of manganese diacid phosphate, $Mn(H_2PO_4)_2$, and 65 percent by weight of ferric diacid phosphate, $Fe(H_2PO_4)_3$; 60 g./l. of zinc nitrate, $Zn(NO_3)_2$.

On the parts thus treated a layer of phosphates, predominantly zinc phosphate with some additional iron and manganese phosphates, ranging in thickness from 9 to 12 microns was obtained.

After washing and drying, the gear wheels were carburized up to 0.9 mm. thickness in a continuous process for 7.5 hours in an endothermal gaseous atmosphere in a zonal oven at a temperature of 920° C., the chemical composition of the gaseous carburizing atmosphere supplied from the generator being as follows: 20 percent of carbon monoxide, 38 percent of hydrogen, 0.1 percent of carbon dioxide and 40 percent of nitrogen.

The parts thus treated were next hardened by heating at a temperature of 820° C. then quenched in oil and tempered for 1.5 hours at a temperature of 150° C.

After having checked the hardness and microstructure of the parts thus treated, and after having compared these results with those obtained for the carburized gear wheels which were not subjected to the preceding phosphatizing step it was shown that the parts thus treated have a uniform high hardness throughout the whole area ranging within the limits from 740 to 780 HV, that is from 62 to 63 Rockwell hardness number. Furthermore, it also has been shown that the superficial layer of those parts contains only martensite. There were no traces of a thin defective superficial oxide layer in spite of the fact that the parts had been carburized in an atmosphere which contained some combined oxygen.

EXAMPLE 2

Shafts of 35 mm. diameter made of low alloy steel with the following composition, by weight: 0.20 percent of carbon, 0.75 percent of manganese, 0.34 percent of silicon, 0.021 percent of phosphorus, 0.015 percent of sulphur, 0.46 percent of chromium, 0.64 percent of nickel, 0.23 percent of molybdenum, 0.08 percent of copper and 0.03 percent of aluminum, after previous cleaning and degreasing, were phosphatized by being dipped for twenty minutes at a temperature of 96° C. in an aqueous solution containing: 24 g./l. of orthophosphoric acid—$H_3PO_4$, 10 g./l. of zinc oxide—ZnO, 14 g./l. of nitric acid—$HNO_3$, and 5 g./l. of potassium nitrate—$KNO_3$.

As a result of the said treatment, a layer of zinc phosphate, ranging in thickness from 10 to 14 microns, was obtained on the parts.

After washing and drying, the shafts were carburized in an endothermal gaseous atmosphere in a continuous process for 20 hours so as to obtain a carburizing layer of 1.8 mm. in thickness.

The chemical composition of the carburizing atmosphere supplied from the generator to the oven was the same as that used in Example 1.

Upon hardening the shafts in oil at a temperature of 150° C. and tempering them for 1.5 hours also in oil at a temperature of 150° C., hardness tests were performed and the microstructure was checked. Results of these tests are given in the table set out hereinafter.

EXAMPLE 3

Rectangular specimens, size 10×20×30 mm., made of low alloy steel having the following composition by weight: 0.17 percent of carbon, 0.76 percent of manganese, 0.27 percent of silicon, 0.026 percent of phosphorus, 0.030 percent of sulphur, 0.47 percent of chromium, 0.16 percent of nickel, 0.56 percent of molybdenum, 0.27 percent of copper and 0.018 percent of aluminum, were first phosphatized by being dipped for 15 minutes at a temperature of 95° C., in an aqueous solution at a temperature of 95° C., in an aqueous solution containing: 35 g./l. of a salt mixture consisting of 35 percent by weight of manganese diacid phosphate, $Mn(H_2PO_4)$, and 65 percent by weight of ferric diacid phosphate, $Fe(H_2PO_4)_3$, as well as 60 g./l. of zinc nitrate, $Zn(NO_3)_2$.

After being thus treated the parts were coated with a phosphate layer ranging in thickness from 12 to 15 microns containing predominantly zinc phosphate with small amounts of iron and manganese phosphates.

After washing and drying, the specimens were carburized to a thickness of 2 mm. in a gaseous atmosphere in an oven at a temperature of 900° C. for 24 hours, together with specimens of identical size made of steel from the same melt which had not been phosphatized.

The composition of the gaseous carburizing atmosphere supplied from a generator was the same as that used in Example 1.

After hardening in oil at a temperature of 170° C. and tempering also in oil at a temperature of 170° C., the specimens were next subjected to superficial hardness tests and microstructure checks.

The following Table sets out the results of tests carried out on parts treated by the process of the invention according to the procedure illustrated in the foregoing Examples (parts 1B, 2B and 3B) compared with parts treated by a process wherein the initial phosphatizing step has been omitted (parts 1A, 2A and 3A).

The test results set out in the Table confirm that the process according to the invention protects the steel parts when being carburized against harmful oxidation and losses of alloying ingredients and ensures, upon hardening and tempering, a uniform high hardness number ranging within the limits from 750 to 780 HV, that is from 61 to 63 HRC throughout the whole surface of the part.

TABLE

| Example No. 1 | Subject of test 2 | File Hardness 3 | Micro-hardness 4 | Microstructure 5 | Carburizing thickness 6 |
|---|---|---|---|---|---|
| 1A | Gear wheel with modulus 6, carburized, hardened and tempered according to Example 1 | none | non-uniform from 460 HV to 550 HV (46–52 HRC) | Soft intermediate structures (soft bainite) appear on a large area in the superficial layer | 0.9 mm. |
| 1B | Gear wheels as above coated with zinc phosphate prior to carburizing, the zine phosphate layer ranging in thickness from 9 to 12 microns acc. to Example 1. | perfect throughout the whole surface | high and uniform throughout the whole surface within the limits from 740 up to 780 HV (62 to 63 HRC) | Uniform martensitic structure in the superficial layer and below it | 0.9 mm. |
| 2A | Carburized, hardened and tempered shafts of 35 mm. diameter acc. to Example 2. | none | low - 440 to 520 HV (44 to 50 HRC) | Thick layer of soft bainite appears in the superficial layer throughout almost the whole surface | 1.8 mm. |
| 2B | Shafts as above with a zinc phosphate coating ranging in thickness from 10 to 14 microns deposited prior to carburizing and then carburized, hardened and tempered acc. to Example 2. | good throughout the whole surface | high and uniform throughout the whole surface within the limits from 750 to 780 HV (62 to 63 HRC) | Uniform martensitic structure appears in the superficial layer and below it | 1.8 mm. |
| 3A | Specimens acc. to Example 3, carburized, hardened and tempered | none | low within the limits from 450 to 500 HV (45 to 50 HRC) which indicates strong oxidation and loss of alloying components | Thick soft bainite layer appears throughout the whole surface in the superficial layer | 2 mm. |
| 3B | Specimens acc. to Example 3, coated with zinc phosphate layer ranging in thickness from 12 to 15 microns, and then carburized, hardened, and tempered | good throughout the whole surface | high throughout the whole surface within the limits from 750 to 780 HV (62 to 63 HRC) | Uniform martensitic structure in the superficial layer and below it | 2 mm. |

We claim:

1. A process for improving the strength, hardness and surface properties of a steel part by a chemical and thermal treatment of the parts which comprises the steps of phosphatizing, carburizing, hardening and tempering the parts carried out in the following sequential order:

(1) phosphatizing the part by treatment with an acidic phosphatizing solution containing zinc ions and phosphate ions to produce on the part a coating ranging in thickness from 5 to 20 microns, the main ingredient of the coating being zinc phosphate;

(2) carburizing the resulting phosphatized part in a gaseous carbon-containing atmosphere; and (3) hardening the part until the superficial layer is substantially all martensite and finally tempering the part.

2. A process according to claim 1, wherein the acidic solution used for the phosphatizing step contains zinc nitrate—$Zn(NO_3)_2$, ferric diacid phosphate—$Fe(H_2PO_4)_3$ and manganese diacid phosphate—$Mn(H_2PO_4)_2$ and the phosphatizing step is carried out at a temperature from 85° to 98° C.

3. A process according to claim 1, wherein the acidic solution used for the phosphatizing step contains phosphoric acid ($H_3PO_4$), zinc oxide (ZnO), nitric acid ($HNO_3$), and potassium nitrate ($KNO_3$), and the phosphatizing step is carried out at a temperature from 90° to 98° C.

4. A process according to claim 1, wherein the carburizing step is carried out in an endothermal gaseous atmosphere having the following composition at the inlet to the oven: 20 percent of carbon monoxide, 38 percent of hydrogen, 0, 2 percent of carbon dioxide, and 40 percent of nitrogen.

5. A steel part having improved strength and hardness properties and having a non-oxidized superficial layer, which has been first phosphatized to provide a superficial coating comprising predominantly zinc phosphate, and which then has been diffusion carburized, hardened and tempered.

* * * * *